US005381981A

United States Patent [19]

Nelson

[11] Patent Number: 5,381,981

[45] Date of Patent: Jan. 17, 1995

[54] GARDEN HOSE REEL

[75] Inventor: Terry N. Nelson, Shoreview, Minn.

[73] Assignee: The Specialty Mfg. Co., St. Paul, Minn.

[21] Appl. No.: 64,856

[22] Filed: May 20, 1993

[51] Int. Cl.[6] ..... B65H 75/14; B65H 75/38

[52] U.S. Cl. ..... 242/407.1; 242/609.2; 242/613.1; 242/614; 137/355.27

[58] Field of Search ..... 242/86, 86.1, 86.2, 242/322, 376, 407, 407.1, 403.1, 406, 609.2, 613.1, 614; 137/355.12, 355.24, 355.26, 355.27

[56] References Cited

U.S. PATENT DOCUMENTS

| | | | |
|---|---|---|---|
| D. 211,531 | 6/1968 | Elmslie . | |
| D. 240,192 | 6/1976 | Balmer . | |
| D. 294,455 | 3/1988 | Nelson | D8/359 |
| D. 294,456 | 3/1988 | Nelson | D8/359 |
| D. 297,302 | 8/1988 | Nelson | D8/358 |
| D. 303,446 | 9/1989 | Kitts et al. | D34/26 |
| D. 312,204 | 11/1990 | Nelson | D8/358 |
| D. 317,113 | 5/1991 | Fowler | D8/358 |
| D. 323,228 | 1/1992 | Spear et al. | D34/27 |
| D. 328,173 | 7/1992 | Nelson | D8/359 |
| 1,046,909 | 12/1912 | Wagner . | |
| 1,255,854 | 2/1918 | Boss . | |
| 1,769,342 | 7/1930 | Hall . | |
| 1,971,165 | 8/1934 | Parker . | |
| 2,488,425 | 11/1949 | Morrone . | |
| 2,512,756 | 6/1950 | Wasserman . | |
| 2,590,963 | 4/1952 | Hannay . | |
| 2,823,074 | 2/1958 | Bernard . | |
| 2,935,996 | 5/1960 | Anderson | 137/355.26 |
| 3,899,132 | 8/1975 | Grobbelaar | 242/86 X |
| 3,940,085 | 2/1976 | Campbell | 242/115 |
| 3,970,268 | 7/1976 | Sheetz | 242/115 |
| 4,137,939 | 2/1979 | Chow | 137/355.27 |
| 4,512,361 | 4/1985 | Tisbo et al. | 137/355.27 |
| 4,700,737 | 10/1987 | Nelson | 137/355.27 |
| 4,768,546 | 9/1988 | Brusadin et al. | 137/355.27 |
| 4,777,976 | 10/1988 | Johnston et al. | 137/355.27 |
| 4,813,627 | 3/1989 | Nelson | 242/107.7 |
| 4,974,627 | 12/1990 | Nelson | 137/355.27 |
| 5,007,598 | 4/1991 | Spear et al. | 242/86.2 |
| 5,046,520 | 9/1991 | Sanchez et al. | 242/86.2 X |
| 5,056,553 | 10/1991 | Whitehead et al. | 242/86 X |

*Primary Examiner*—John M. Jillions
*Attorney, Agent, or Firm*—Patterson & Keough

[57] ABSTRACT

A garden hose reel is provided that is light weight, durable, and easily assembled. The reel is made of right and left, molded, synthetic resin halves that are easily joined together by complementary interlocking structures on the matable faces of each reel half and by screw fasteners. The complementary interlocking structures on the matable faces distribute the torque forces that would otherwise be concentrated at the screws. The reel halves each include an inwardly tapered hose support surface and inwardly biased opposed reel sides that promote centering of the hose as unwound hose is taken up on the assembled reel. The hose reel can be rotatably supported by either a wall mounted frame or a portable caddy frame. The frames include molded synthetic resin right and left side frame members that are coupled together by light weight metal tubular frame members. The tubular frame members are received in molded sockets formed in the side members and are held there by a durable assembly comprised of a screw fastener and a transverse plate positioned in opposed slots in the tubular frame member.

10 Claims, 6 Drawing Sheets

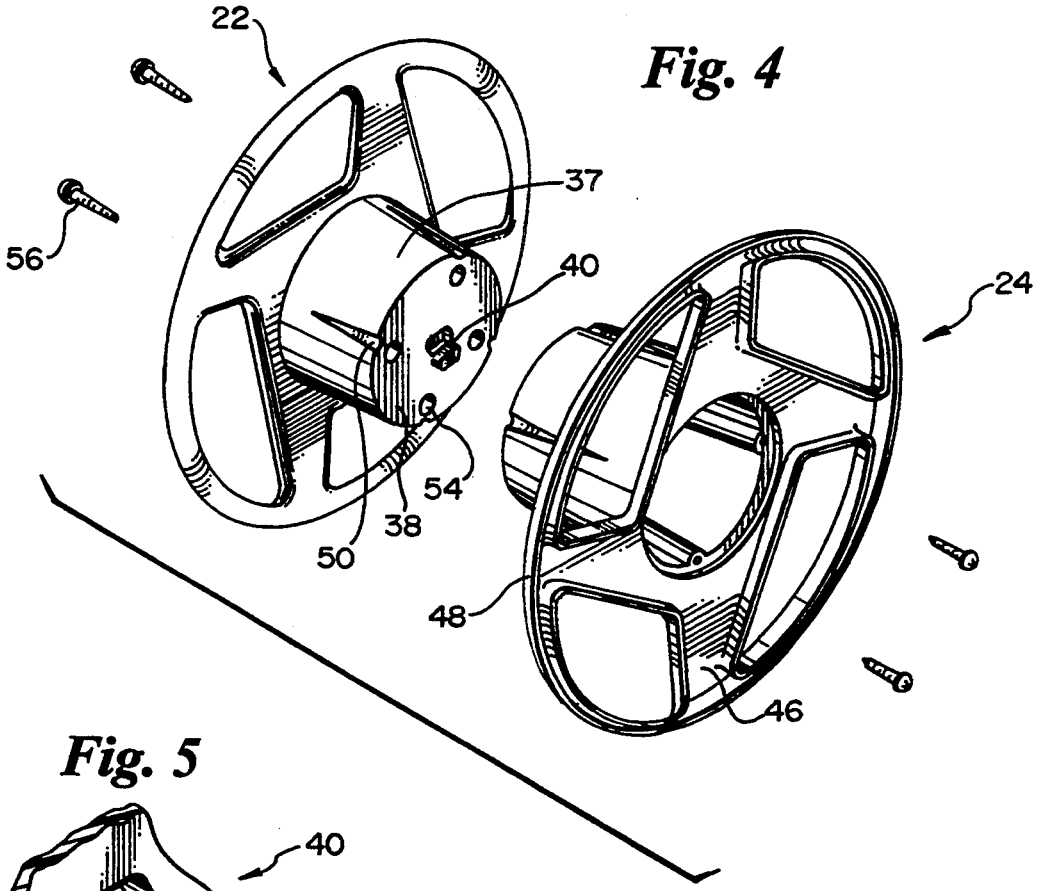
Fig. 4
Fig. 5
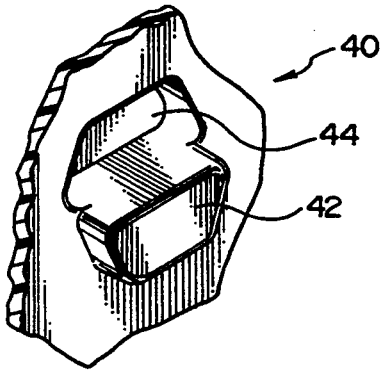
Fig. 6
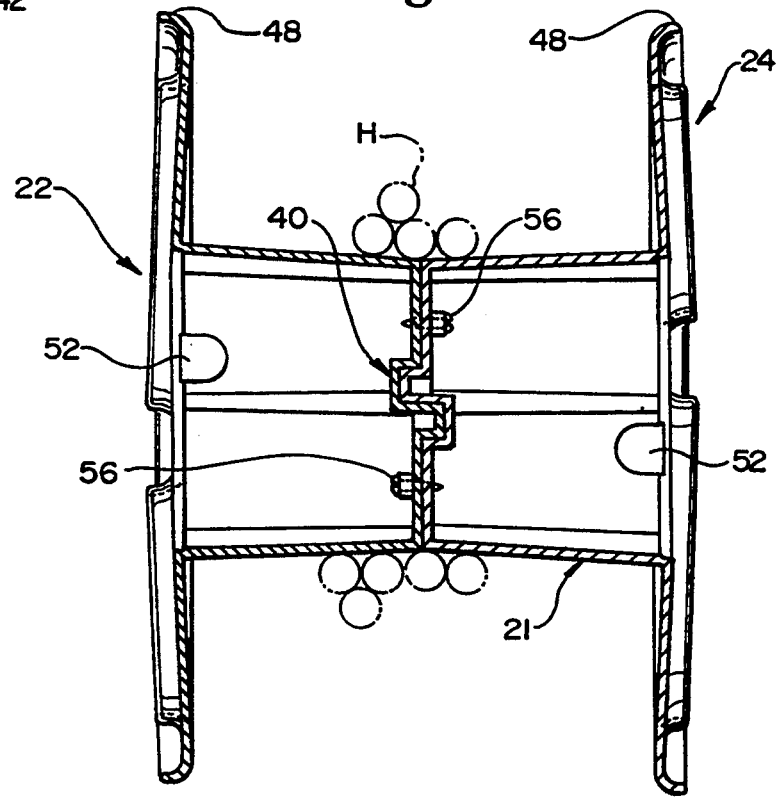

GARDEN HOSE REEL

TECHNICAL FIELD

This invention pertains to lawn care devices. In particular, it pertains to a garden hose reel assembly especially designed for light weight, durability, and ease of assembly.

BACKGROUND ART

Hose reel assemblies for storing garden hoses are known in the art. A hose reel that serves in either a wall mounted or caddy mounted position is disclosed in U.S. Pat. No. 4,700,737. A caddy mounted hose reel assembly with a low center of gravity is disclosed in U.S. Pat. No. 4,974,627. Other variations of garden hose reel assemblies are disclosed in U.S. Pat. Nos. 3,587,626, 4,137,939, and 4,512,361.

Hose reel assemblies have proven to be popular and satisfactory mechanisms for garden hose storage. With the advent of synthetic resins, a number of hose reel designs have been proposed, including designs disclosed in the above cited patents, to take advantage of the light weight and resistance to corrosion offered by synthetic resins.

A number of problems remain, however, in the incorporation of synthetic resins in to hose reel designs. As garden hose is taken up by hose reels, for instance, considerable stress is imposed upon the outside of the reel including the spokes and rim of the reel sides. This stress may present itself even when only a portion of the hose has been wound on to the reel because the hose often tends to be taken up at the outside edges of the hose support surface. Hose reel sides made of synthetic resins, in particular, accordingly have a tendency to bend outwardly, causing interference with the frame members supporting the hose reel.

Other problems presented by synthetic resin based hose reels include maintaining light weight and ease of assembly in the design, while keeping the overall structure as durable as possible.

SUMMARY OF THE INVENTION

The improved garden hose reel assembly in accordance with the present invention is especially designed for light weight, durability, and ease of manufacture and assembly. The problem outlined above relating to the outward expansion of hose reel sides is solved with the unique design of the hose reel hereof, without sacrificing the light weight and resistance to corrosion provided by synthetic resins. Ease of assembly and inherent structural strength are designed into the reel and the supporting frame for the reel through the use of unique coupling devices.

The garden hose reel assembly hereof includes a windable hose reel that can be rotatably supported by either a wall mounted or portable caddy frame. The reel is made of right and left, molded, synthetic resin halves that are matably joined together and secured by a plurality of screw fasteners. The two halves include complementary interlocking structures that distribute the torque forces between the two halves that would otherwise be concentrated at the screws.

The reel halves of the hose reel each present an inwardly tapered, frusto-conical hose support surface such that the otherwise generally cylindrical reel surface presented by the joined reel halves is canted radially inwardly towards the middle portion of the reel at the juncture of the two halves. The radially outwardly extending opposed reel sides are tapered and biased axially inwardly towards each other. The combined effect of the downwardly and inwardly cant of the reel surface, and the axially inwardly taper of the reel sides, is to center the coils of hose as the hose is wound around the reel. Additionally, the reel sides resist outward bulging from the pressure of the wound hose that could otherwise interfere with rotation of the reel relative to the frame rotatably supporting the reel.

The frame supporting the hose reel can be either a wall mounted frame or a portable caddy frame. The right and left side frame members of both the wall mounted and caddy frame are molded synthetic resin members. The side frame members are coupled together by lightweight, preferably aluminum, generally tubular frame members. The tubular frame members are received in molded sockets formed in the side members and are held therein by a durable attachment assembly comprised of a screw fastener and a transverse plate positioned in opposed slots in the tubular frame member.

BRIEF DESCRIPTION OF THE DRAWINGS

FIG. 4 is an exploded perspective view of the interlocking reel halves making up the hose reel of the hose reel assembly;

FIG. 5 is an enlarged, fragmentary, perspective view of the interlock structure of the reel halves depicted in FIG. 4;

FIG. 6 is a cross-sectional view taken through the mated faces of two reel halves;

DETAILED DESCRIPTION OF THE DRAWINGS

Figure 1:
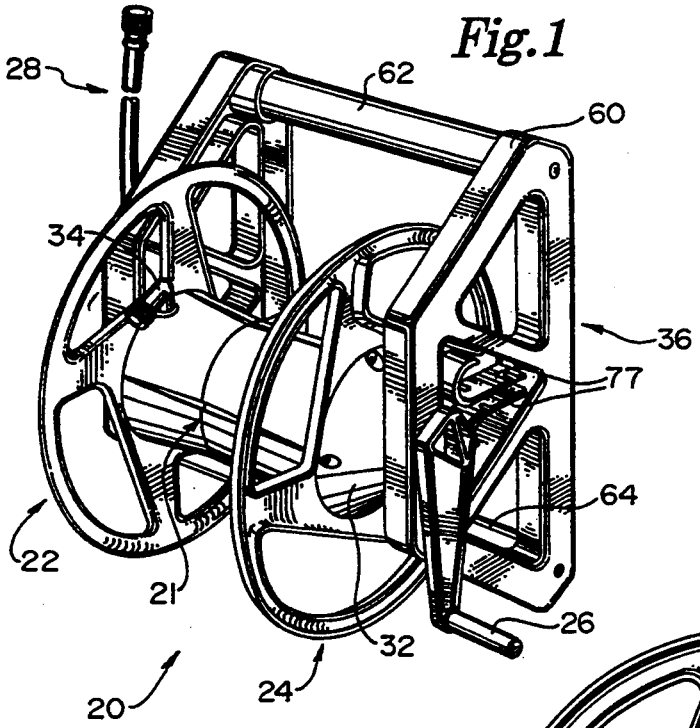
FIG. 1 is a perspective view of a wall mounted garden hose reel assembly in accordance with the present invention.

A wall mounted garden hose reel assembly 20 in accordance with the present invention broadly includes a hose reel 21 preferably comprised of synthetic resin interlocking left and right opposing reel halves 22, 24, a hand crank 26, an inlet tube and connecting hose extension 28, left and right flanged hubs 30, 32, carried by respective have reel halves 22, 24, and an outlet tube 34.

Figure 2:
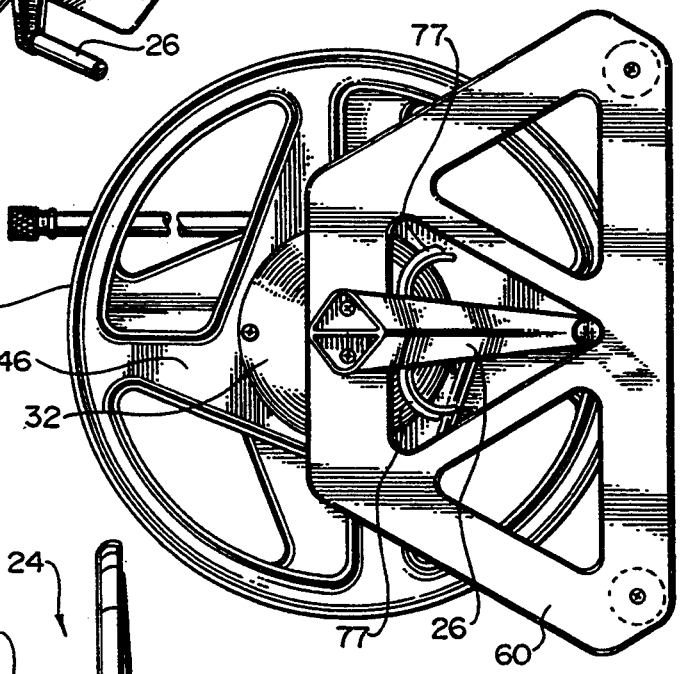
FIG. 2 is a right side elevational view of the hose reel assembly depicted in FIG. 1.
Figure 3:
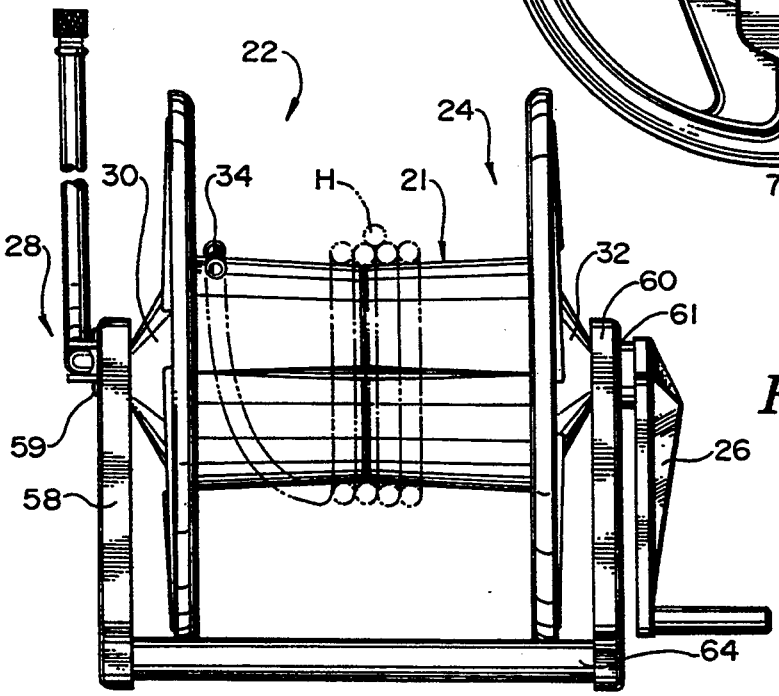
FIG. 3 is a bottom view of the hose reel assembly depicted in FIG. 1.
Figure 9:
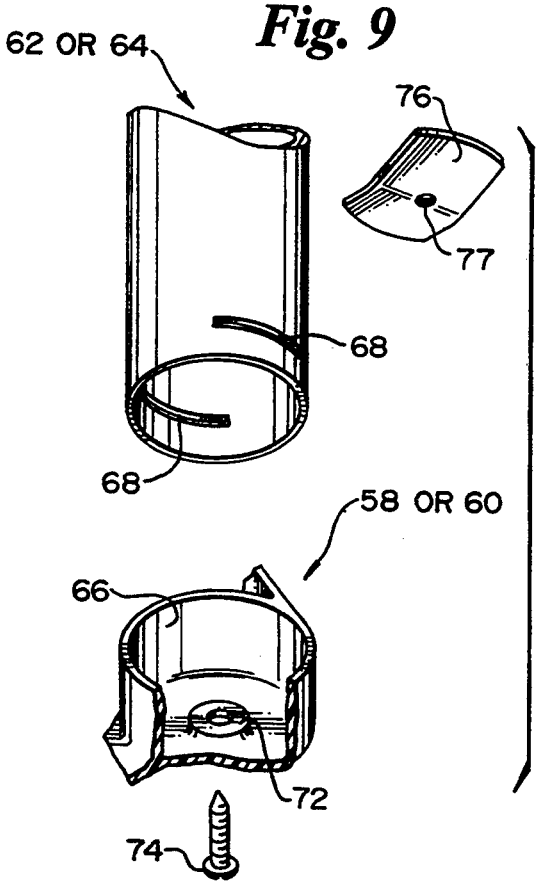
FIG. 9 is an exploded view of the cylindrical frame member, trapezoidal frame member and socket depicted in FIG. 7.
Figure 7:
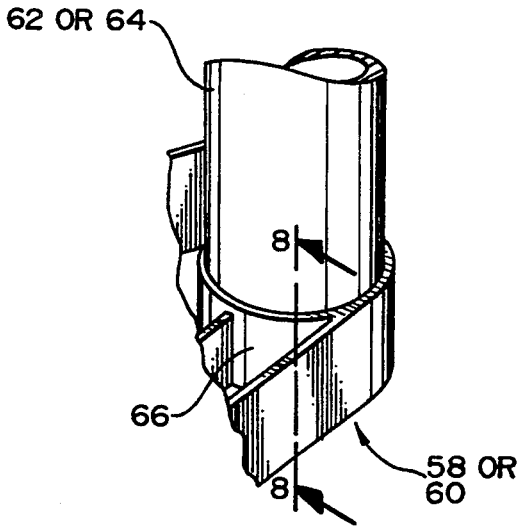
FIG. 7 is a fragmentary perspective view of a cylindrical frame member of the hose reel assembly inserted into the socket of a trapezoidal frame member of the hose reel assembly.

As depicted in FIGS. 1–3, the hose reel 21 is rotatably supported by wall mounting frame 36.

As depicted in FIG. 4, the opposed left and right reel halves 22, 24 are preferably integrally molded pieces generally including support spokes 46 and a rim 48, rigidifying grooves 50, and frusto-conically tapered hose support surfaces 37 narrowing to central mutually matable faces 38. In a preferred embodiment, each hose support surface 37 is tapered inwardly about three degrees from a line parallel with the axis of rotation.

The mutually matable faces 38 of the reel halves 22, 24 have interlocks 40 and screw holes 54. As depicted in FIG. 5, the interlock 40 of the reel halves 22, 24 is composed of a projection 42, receivable in a complementary fit into a depression 44 of the other hose reel half 22, 24. The support spokes 46 and rim 48 are positioned at the outward sides of each the reel halves 22, 24.

Referring to FIG. 6, the spokes 46 are inwardly biased. A preferred inward bias of the spokes 46 is about three degrees inward from a line perpendicular to the axis of rotation.

The rigidifying grooves 50 of the hose reel halves 22, 24 extend laterally from near the junction of the support spokes 46 and the hose support surface 37 to the matable face 38 and are molded into the hose support surface 37. A cutout 52 for receiving the inlet tube 28 is provided on the hose support surface near the support spokes 46.

The mutually matable faces 38 of the two hose reel halves 22, 24 are joined together in abutting relationship with fasteners 56 received through screw holes 54. A length of hose H, depicted in phantom lines in FIGS. 3 and 6 can be coiled around the reel halves 22, 24.

The reel halves may have a multiplicity of interlocking projections 42 and depressions 44, if desired, but a preferred embodiment is one axially oriented interlock 40 having a trapezoidal in cross section projection 42 received in a single, complementary depression 44. The projection 42 may be of any shape, provided that the shape conforms to the shape of the depression such that when the faces 38 of two reel halves are abutted, the faces 38 will mate.

The mounting frame 36 generally includes left and right trapezoidal preferably integrally molded, synthetic resin frame members 58, 60, and upper and lower horizontally positioned, metal cylindrical frame members 62, 64.

Left side trapezoidal frame member 58 includes a hub receiving aperture 59 for rotatably receiving hub 30. Sockets 66 are located in the upper and lower corners of the longest trapezoidal dimension. Right trapezoidal frame member 60 contains a hub receiving aperture 61 for rotatably receiving hub 32. Sockets 66 are located in the upper and lower corners of the longest trapezoidal dimension. Each socket 66 includes one end of a cylindrical frame member 62, 64. The sockets 66 each include a well 72, indented with respect to the outside edge of the trapezoidal frame member. A fastener receiving aperture 73 is presented by each well 72 for receiving a fastener 74.

Slots 68 are present in each end of the upper and lower cylindrical frame members 62, 64. The slots 68 receive a slightly bent but generally rectangular plate 76, possessing arcuate edges on the narrowest dimension. Each plate includes a generally centered, screw receiving aperture 77 for receiving fastener 74. The cylindrical frame members 62, 64 are preferably formed from a lightweight metal such as aluminum. The plates 76 are preferably formed from a stronger, more durable metal such as stainless steel. A strong durable coupling of the cylindrical frame members 62, 64 to the left and right side frame members 58, 60 is thereby provided, while maintaining the lightweight of the entire assembly 20.

The left and right flanged hubs 30, 32 are each fixedly fastened to the outside edge of a respective one of the reel halves 22, 24. The left flanged hub 30 rotatably extends through the hub receiving aperture 59 in frame member 58 and is thence fixedly coupled to the inlet tube and connecting hose extension 28. Right flanged hub 32 rotatably extends through the hub receiving aperture 61 in frame member 60. Hand crank 26 is carried by the right hub 32.

Referring to FIGS. 1 and 2, wall mount hooks 77 can be molded into the side frame 60. The hooks 77 can be detached from the frame 60 and secured to a wall for hanging up the assembly 20 by engagement of tubular frame member 62 by the hooks 77.

Figure 10:
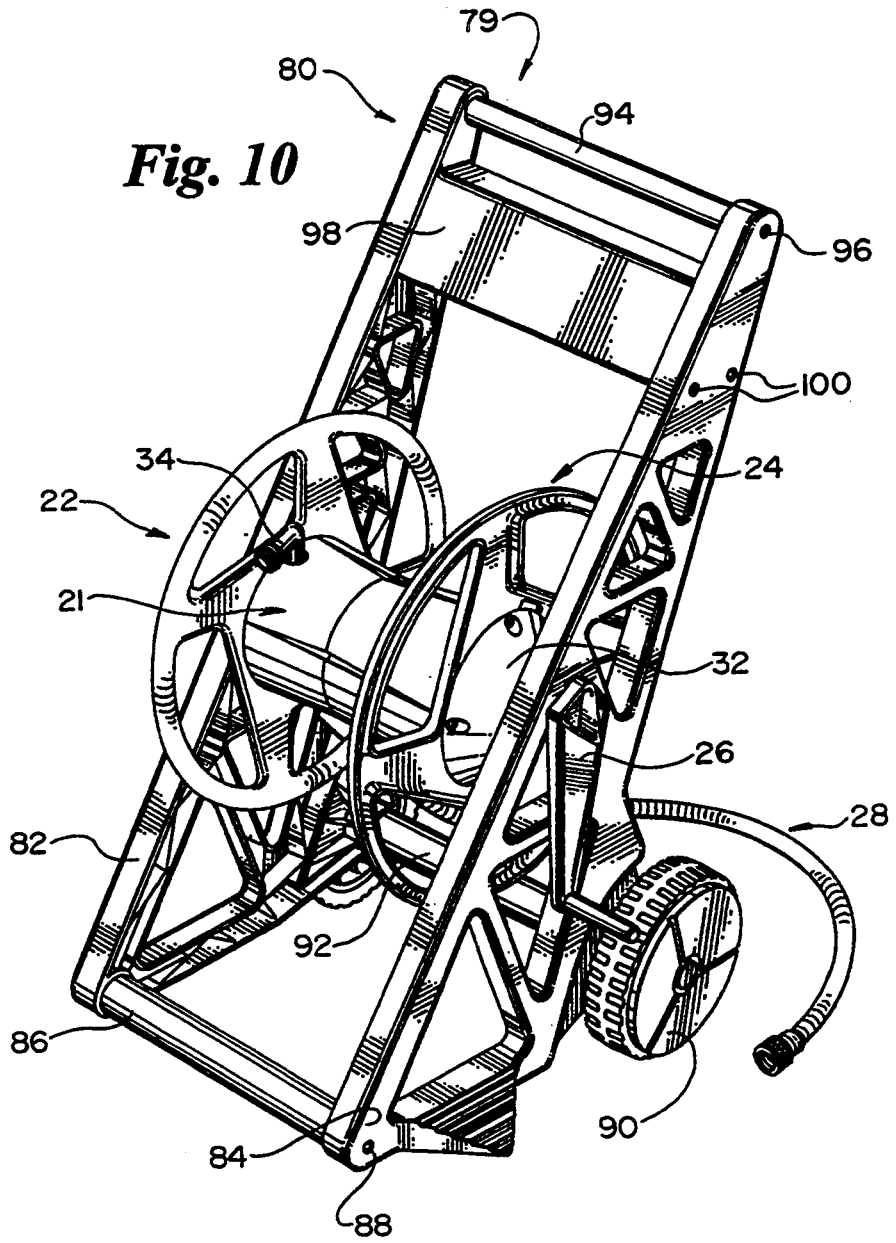
FIG. 10 is a perspective view of a second embodiment of the hose reel assembly in accordance with the present invention, comprising a portable caddy mounted garden hose reel assembly.
Figure 11:
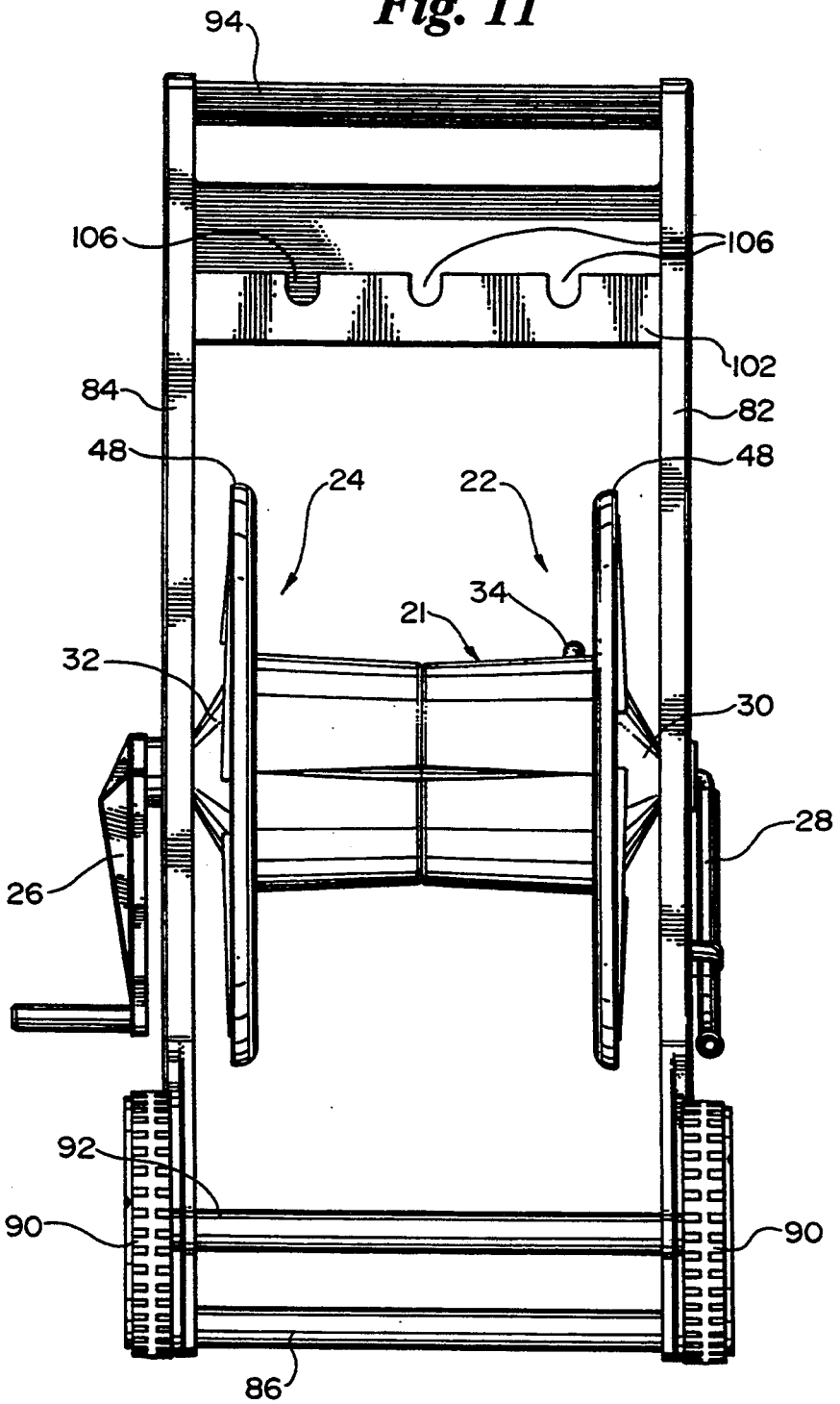
FIG. 11 is a rear elevational view of the caddy mounted hose reel assembly depicted in FIG. 10.
Figure 12:
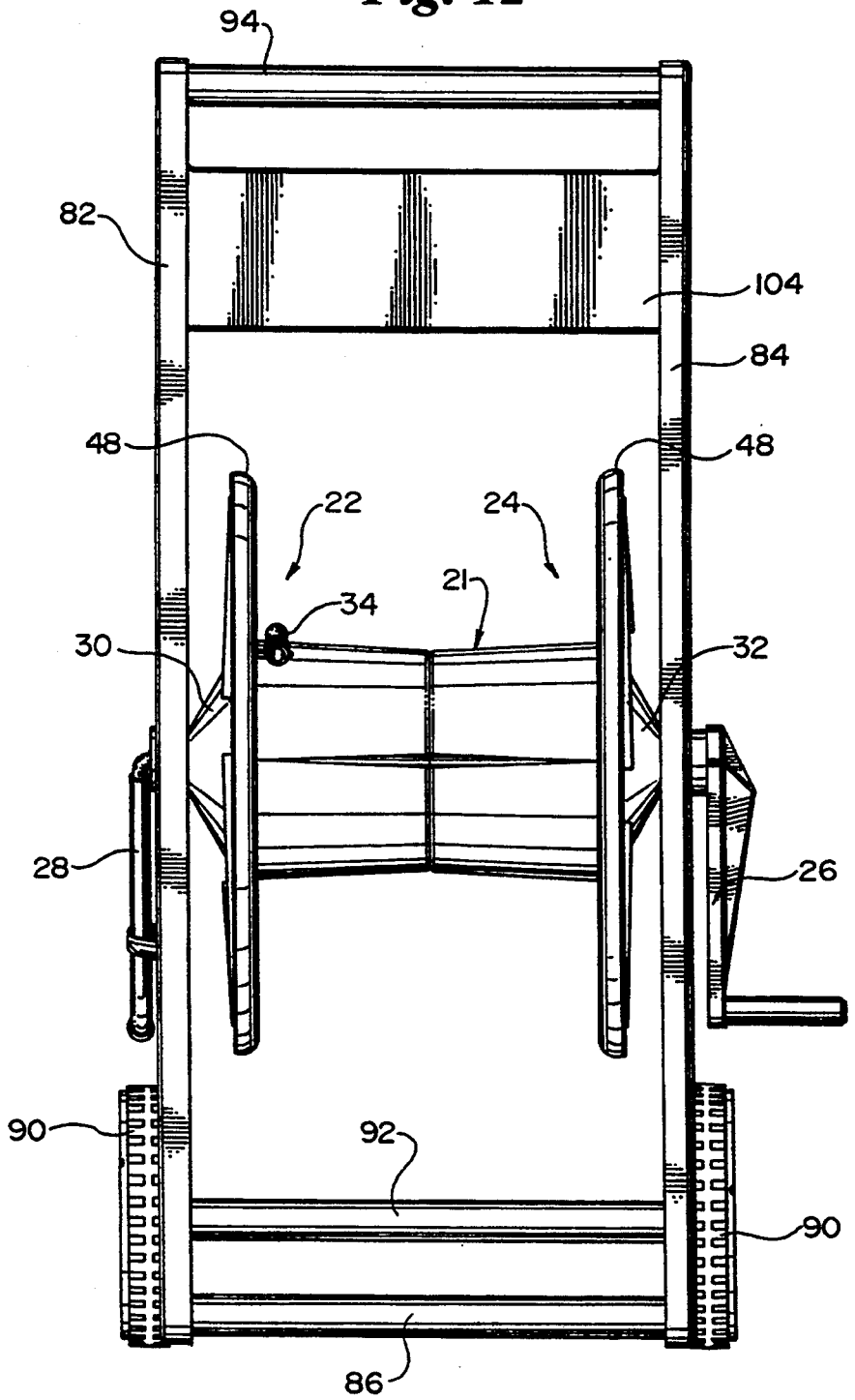
FIG. 12 is a front elevational view of the caddy mounted hose reel assembly depicted in FIG. 10.

Referring to FIGS. 10–12, a second embodiment of the hose reel assembly in accordance with the present invention comprises a portable caddy mounted hose reel assembly 79. The hose reel 21 of the caddy mounted hose reel assembly 79 is identical to the reel 21 depicted and described in conjunction with the wall mounted hose reel assembly 20 above, and like elements are annotated with the same number in each of the embodiments. The hose reel assembly 79 broadly includes preferably synthetic resin interlocking left and right opposing reel halves 22, 24, a hand crank 26, an inlet tube and connecting hose extension 28, left and right flanged hubs 30, 32, an outlet tube 34 for a watertight extension to hose H, and a caddy assembly 80.

Caddy assembly 80 includes generally parallel, preferably integrally molded synthetic resin left and right side frames 82, 84, front cylindrical frame member 86, transport wheels 90, rear cylindrical frame member 92, a cylindrical frame member comprising a cross bar handle 94 and hose end supporter 98. The side frames 82, 84 include sockets 89 for receiving the ends of cylindrical frame members 86, 92 and 94.

Front cylindrical frame member 86 is coupled to the forwardmost point of each side frame 82, 84 by a fastener 88. Transport wheels 90 are rotatably coupled to the caddy assembly 80 outwardly of the side frames 82, 84. The wheels 90 are fixed in a spaced apart relationship by rear cylindrical frame member 92. Cross bar handle 94 is joined to left and right side frames 82, 84 by fasteners 96. Hose supporter 98 is joined to the left and right side frames 82, 84 by fasteners 100. The cylindrical frame members 86, 92 and handle 94 are identical in construction to the structure of the cylindrical frame members 62, 64 described above in conjunction with the wall mounted hose reel assembly 20, and fasteners 88, 96, 100 are identical to the above described fastener 74.

Hose supporter 98 is an integrally molded piece preferably of moderately flexible synthetic resin including, as best seen in FIG. 11, a generally vertical hose receiving plate 102, and as best seen in FIG. 12, a splash guard 104. The hose receiving plate 102 has a plurality of hose receiving notches 106. The top of the plate 102 is located below and to the rear of the splash guard 104. The splash guard 104 is located forwardly and upwardly of the hose receiving notches 106.

Figure 8:
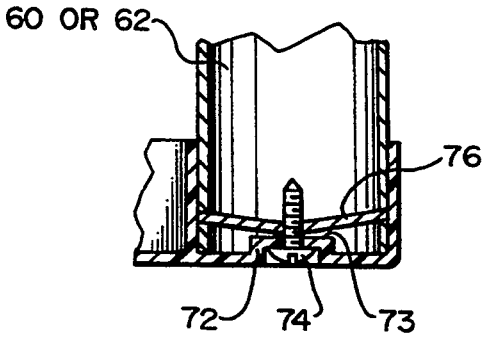
FIG. 8 is a fragmentary, cross-sectional view taken along the line 8—8 of FIG. 7.

The hose reel 21 is easily assembled. Prior to operation, the faces 38 of the left reel half 22 and right reel half 24 are mated and fastened such that each projection 42 of interlocks 40 mates with a corresponding depression, as best seen in FIG. 8. The interlocks 40 quickly and easily align the two reel halves 22, 24. Moreover, the interlocks 40 distribute the forces imposed on the reel fasteners 56, thus extending the useful life of the assembly.

The frames of the hose reel assemblies 20, 80 are assembled by inserting a flat rectangular plate 76 into slots 68 in each end of the cylindrical frame members (62, 64 in the case of assembly 20 and 86, 92, 94 in the case of assembly 80), and thence into respective sockets carried by the frame members. Fasteners 74, 88, 96, 100 are inserted through wells 72 and are fastened to plates 76. As the fasteners are individually tightened, plates 76 are bent, as depicted in FIG. 8. After being bent, the arcuate edges of each plate 76 engage the inner walls of socket 66, providing a firm relationship between the cylindrical frame members and the receiving frame members. The unique design of the cylindrical frame members and their attachment mechanism provides for easy assembly of a rigid, secure frame for the hose reel assemblies 20, 80.

In operation, the hose reel assembly 20 and mounting frame 36 comprise a wall mounted garden hose extension and retraction system. As depicted in FIG. 1 and FIG. 3, the hose H is coiled about the hose reel support surface with the inner end of the hose H connected in a water tight manner to outlet tube 34. Caddy hose reel assembly 80 operates similarly, but the caddy assembly 80 is portable.

As an extended hose is taken up, the inwardly tapered hose support surface 37 promotes a tendency for the hose to coil towards the center of the hose reel 20. The inward bias of the spokes 46 also serves to direct the hose towards the center of the hose reel assembly 20 during hose retraction.

When hose does reach an edge during rewinding, the inward bias of the support spokes 46 and rim 48 further promote coiling of the hose in the center. These factors relieve stresses on the spokes 46 and rim 48. The same effect is accomplished by the hose reel 61 of the caddy mounted hose reel assembly 60.

As best seen in FIG. 11, hose end supporter 98 of the caddy mounted hose reel assembly is capable of receiving hose ends in hose receiving notches 106. The notches 106 are of a width suitable to receive hose ends from different diameter of hose ends and hose couplers. The number of hose receiving notches 106 may be any suitable number, three notches being depicted in the drawings.

I claim:

1. A hose reel assembly for windably storing and dispensing flexible hose comprising:

a support frame; and a hose supporting reel rotatably carried by said support frame along a generally horizontal reel axis of rotation, said reel including a generally cylindrical hose supporting surface oriented around said reel axis of rotation and opposed reel sides extending radially outwardly relative to said hose supporting surface, said reel presenting a middle portion between said reel sides, and said reel sides each presenting a base portion and a circumferential rim oriented radially outwardly from said base portion, said generally cylindrical hose supporting surface being canted radially inwardly from the opposed reel sides towards the middle portion of the reel, and said reel sides being tapered axially inwardly towards said reel middle portion such that said reel side circumferential rims are oriented closer together than said reel side base portions whereby said generally cylindrical hose supporting surface and said tapered reel sides act cooperatively to urge said hose toward said middle portion as it is wound on to said reel, and to resist outward bulging against said support frame under pressure of said wound hose.

2. The invention as claimed in claim 1, said hose reel comprising separate right and left reel halves and reel half coupling means for coupling said halves together at said reel middle portion, each of said halves presenting an axially inwardly tapered, frusto-conical hose support surface.

3. The invention as claimed in claim 2, each of said reel halves presenting a matable face abutable with the matable face of the other of said reel halves, said reel half coupling means including interlocking means operably carried by each of said matable faces for mutual, complementary engagement of said reel halves, and fastening means for fastening said reel halves together.

4. The invention as claimed in claim 3, said interlocking means comprising a boss projecting outwardly from the matable face of one of said reel halves, and structure defining a boss receiving recess on the matable face of the other of said reel halves.

5. The invention as claimed in claim 2, said inwardly tapered, frusto-conical hose support surfaces of said reel halves each being canted radially inwardly at an angle of about three degrees to the reel axis of rotation.

6. The invention as claimed in claim 1, said reel sides being tapered axially inwardly towards said reel middle portion at an angle of about three degrees relative to a plane being generally perpendicular to said reel axis of rotation.

7. The invention as claimed in claim 1, said support frame including right and left side frame members and generally tubular frame members extending between said right and left side frame members, said tubular frame members each presenting opposed ends, and frame coupling assemblies for operably coupling respective ends of said tubular members and said side frame members.

8. The invention as claimed in claim 7, said frame coupling members each comprising structure defining a tubular frame member end receiving socket in a respective side frame member and attachment means for securing a respective tubular frame member end within said socket.

9. The invention as claimed in claim 8, said attachment means comprising structure defining opposed slots in the end of a respective tubular frame member end, a span plate carried within said opposed slots and across said tubular frame member end, and a fastener element received by said span plate and said structure defining said socket for operably attaching said span plate to said side frame.

10. A hose reel assembly for windably storing and dispensing flexible hose comprising:

a support frame, said support frame including right and left side frame members and generally tubular frame members extending between said right and left side frame members, said tubular frame members each presenting opposed ends, and frame coupling assemblies for operably coupling respective ends of said tubular members and said side frame members, said frame coupling assemblies each comprising structure defining a tubular frame member end receiving socket in a respective side frame member and attachment means for securing a respective tubular frame member end within said socket, said attachment means comprising structure defining opposed slots in the end of a respective tubular frame member end, a span plate carried with said opposed slots and across said tubular frame member end, and a fastener element received by said span plate and said structure defining said socket for operably attaching said span plate to said side frame; and a hose supporting reel rotatably carried by said support frame along a generally horizontal reel axis of rotation, said reel including a generally cylindrical hose supporting surface oriented around said reel axis of rotation and opposed reel sides extending radially outwardly relative to said hose supporting surface, said reel presenting a middle portion between said reel sides, said generally cylindrical hose supporting surface being canted radially inwardly from the opposed reel sides towards the middle portion of the reel, and said reel sides being tapered axially inwardly towards said reel middle portion whereby said hose is urged toward said middle portion as it is wound on to said reel, and said reel sides resist outward bulging against said support frame under pressure of said wound hose.

* * * * *